US008732979B2

(12) United States Patent
Ashrafzadeh et al.

(10) Patent No.: US 8,732,979 B2
(45) Date of Patent: May 27, 2014

(54) VARIABLE AIRFLOW IN LAUNDRY DRYER HAVING VARIABLE AIR INLET

(71) Applicant: Whirlpool Corporation, Benton Harbor, MI (US)

(72) Inventors: Farhad Ashrafzadeh, Bowling Green, KY (US); Michael T. Dalton, Saint Joseph, MI (US); Layne E. Heilman, Osceola, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/747,817

(22) Filed: Jan. 23, 2013

(65) Prior Publication Data

US 2013/0118027 A1 May 16, 2013

Related U.S. Application Data

(62) Division of application No. 12/837,526, filed on Jul. 16, 2010, now Pat. No. 8,387,274.

(51) Int. Cl.
*F26B 3/02* (2006.01)

(52) U.S. Cl.
USPC ..... 34/601; 34/603; 34/608; 68/5 C; 68/18 R; 8/137

(58) Field of Classification Search
USPC ..... 34/443, 488, 497, 595, 601, 602, 603, 34/608, 609; 68/5 C, 5 R, 18 R, 20; 8/137, 8/159
See application file for complete search history.

(56) References Cited

U.S. PATENT DOCUMENTS

| | | | | | |
|---|---|---|---|---|---|
| 1,598,660 | A * | 9/1926 | Sieben | 34/231 |
| 2,505,041 | A * | 4/1950 | Gorsuch | 34/527 |
| 2,573,571 | A * | 10/1951 | Howland | 34/546 |
| 2,643,463 | A * | 6/1953 | Grantham | 34/546 |
| 3,023,514 | A * | 3/1962 | Gibson | 34/589 |
| 3,234,660 | A * | 2/1966 | Williams et al. | 34/527 |
| 3,239,945 | A * | 3/1966 | Cobb et al. | 34/527 |
| 3,286,361 | A * | 11/1966 | Cobb et al. | 34/445 |
| 3,330,047 | A * | 7/1967 | Rodgers | 34/532 |
| 3,555,701 | A * | 1/1971 | Hubbard | 34/602 |
| 4,062,128 | A * | 12/1977 | Bledsoe | 34/580 |
| 4,665,628 | A * | 5/1987 | Clawson | 34/449 |
| 5,228,212 | A * | 7/1993 | Turetta et al. | 34/493 |
| 5,555,645 | A * | 9/1996 | Joslin | 34/499 |
| 6,199,300 | B1 * | 3/2001 | Heater et al. | 34/446 |
| 6,446,357 | B2 | 9/2002 | Woerdehoff et al. | |
| 7,055,262 | B2 * | 6/2006 | Goldberg et al. | 34/86 |
| 2004/0078995 | A1 * | 4/2004 | Forget et al. | 34/601 |
| 2006/0254082 | A1 * | 11/2006 | Kim | 34/595 |
| 2007/0209228 | A1 * | 9/2007 | Meerpohl et al. | 34/595 |
| 2012/0011738 | A1 * | 1/2012 | Ashrafzadeh et al. | 34/488 |

FOREIGN PATENT DOCUMENTS

| | | | | |
|---|---|---|---|---|
| DE | 4422191 | A1 * | 1/1995 | D06F 58/24 |
| EP | 217234 | A1 * | 4/1987 | D06F 37/20 |
| EP | 655523 | A1 * | 5/1995 | D06F 39/02 |
| JP | 08206385 | A * | 8/1996 | D06F 25/00 |

* cited by examiner

*Primary Examiner* — Steve M Gravini

(57) ABSTRACT

A laundry treating appliance and a method for operating the appliance to supply air into a treating chamber through an air inlet and controlling the supplied air by varying the effective area of the air inlet.

8 Claims, 15 Drawing Sheets

VARIABLE AIRFLOW IN LAUNDRY DRYER HAVING VARIABLE AIR INLET

CROSS-REFERENCE TO RELATED APPLICATIONS

The present application represents a divisional application of U.S. patent application Ser. No. 12/837,526 entitled "Variable Airflow in Laundry Dryer Having Variable Air Inlet" filed Jul. 16, 2010, pending.

BACKGROUND OF THE INVENTION

A laundry treating appliance, such as a clothes dryer, typically has a configuration based on a rotating drum that defines a treating chamber in which laundry items are placed for treatment. The clothes dryer may have a controller that implements a number of pre-programmed cycles of operation to remove moisture from the laundry items by the application of heat, typically through a heated airflow.

SUMMARY OF THE INVENTION

The invention relates to a laundry treating appliance for treating laundry in accordance with an automatic cycle of operation and a method of operating the appliance. The appliance includes a treating chamber, a variable-area air inlet fluidly coupled with the treating chamber, an air outlet fluidly coupled with the treating chamber, with the air inlet and air outlet defining an air flow path through the treating chamber, and an air mover fluidly coupled with at least one of the air inlet and air outlet to effect the movement of air along the air flow path.

DESCRIPTION OF EMBODIMENTS OF THE INVENTION

Figure 1:
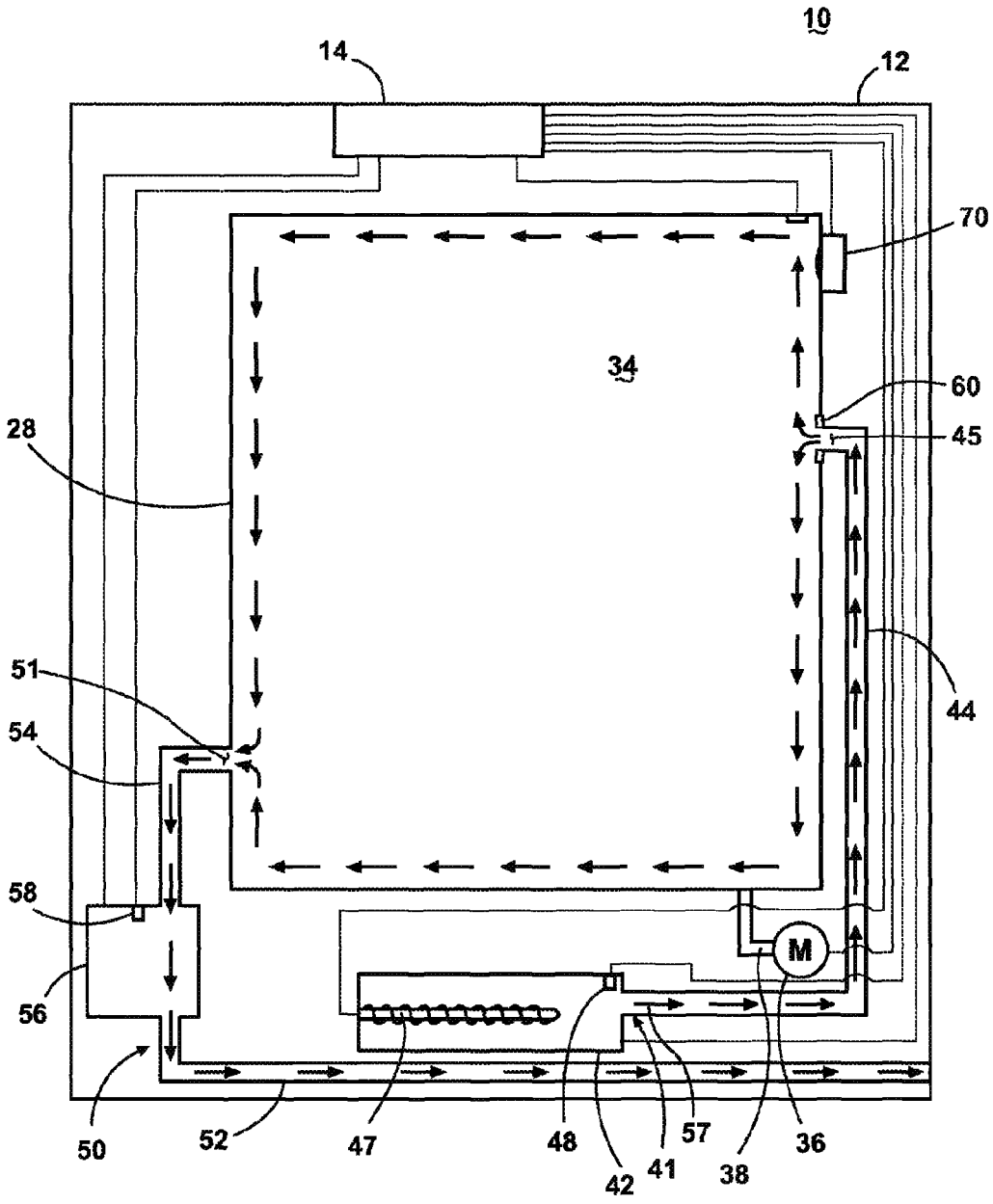
FIG. 1 is a schematic view of a laundry treating appliance according to a first embodiment of the invention.

FIG. 1 illustrates a first embodiment of a laundry treating appliance 10 in the form of a clothes dryer according to the invention. While the laundry treating appliance 10 is illustrated as a clothes dryer, the laundry treating appliance 10 according to the invention may be any appliance which performs a cycle of operation on laundry, non-limiting examples of which include a horizontal or vertical axis clothes dryer; an air vented dryer; a condenser dryer; a combination washing machine and dryer; a refreshing/revitalizing machine; an extractor; and a non-aqueous washing apparatus. The laundry treating appliance 10 described herein shares many features of a traditional automatic clothes dryer, which will not be described in detail except as necessary for a complete understanding of the invention.

The laundry treating appliance 10 may include a cabinet 12 having a controller 14 for controlling the operation of the laundry treating appliance 10 to complete a cycle of operation. A rotatable drum 28 may be located within the cabinet 12 to define a treating chamber 34 for receiving laundry to be treated during a cycle of operation.

The drum 28 may be rotated by any suitable drive mechanism, such as an indirect drive, which is illustrated as a motor 36 and a coupled belt 38. Some non-limiting examples of indirect drives are: three-phase induction motor drives, various types of single phase induction motors such as a permanent split capacitor (PSC), a shaded pole and a split-phase motor. Alternately, the motor 36 may be a direct drive motor, as is known in the art. Some non-limiting examples of an applicable direct drive motor are a brushless permanent magnet (BPM or BLDC) motor and an induction motor. The motor 36 may be operably coupled with the controller 14 to control the rotation of the drum 28 to complete a cycle of operation.

Still referring to FIG. 1, an air flow system for the laundry treating appliance 10 according to the first embodiment of the invention will now be described. The air flow system provides air along an air flow path that passes through the treating chamber 34 and may have an inflow portion 41 that may be formed in part by an inlet conduit 42. The inlet conduit may have one end open to the ambient air and another end fluidly coupled with an inlet channel 44, which may be in fluid communication with the treating chamber 34 through an air inlet 45. A heating element 47 may be located within the inlet conduit 42 and may be operably coupled with and controlled by the controller 14. If the heating element 47 is turned on, the air supplied through the air inlet 45 will be heated. The inflow portion 41 may further include an inflow temperature sensor 48 to sense the temperature of the air supplied through the air inlet 45 to the treating chamber 34. The inflow temperature sensor 48 may be located anywhere in the inflow portion 41 and may be operably coupled with the controller 14.

The air flow system may further include an outflow portion 50 that may be formed in part by an air outlet 51, an exhaust conduit 52, and an exhaust channel 54, all of which may be fluidly coupled by an air mover or blower 56. Thus, the air inlet 45 and air outlet 51 define a portion of an air flow path in the laundry treating appliance 10 as illustrated by arrows 57, and the blower 56 may be fluidly coupled with the air flow path and operates to effect the movement of air along the air flow path. More specifically, operation of the blower 56 both draws air into the treating chamber 34 through the air inlet 45 and exhausts air from the treating chamber 34 to the outside of the laundry treating appliance 10 through the air outlet 51. The blower 56 may be operably coupled with and controlled by the controller 14. The outflow portion 51 may further include an outflow temperature sensor 58 to sense the temperature of the air exhausted from the treating chamber 34. The outflow temperature sensor 58 may be located anywhere in the outflow portion 51 and may be operably coupled with the controller 14.

The laundry treating appliance 10 may also have an adjustable air flow restrictor 60 fluidly coupled with the air inlet 45 and operable to vary the effective area of the air inlet 45. For example, the adjustable air flow restrictor 60 may selectively close off a portion of the air inlet 45 to vary the effective area of the air inlet 45. The air flow restrictor 60 may be operably coupled with the controller 14 to selectively vary the effective area of the air inlet 45.

The laundry treating appliance 10 may also include an imaging system 70 such as an optical sensor or camera to capture one or more images of the treating chamber 34. The imaging system 70 may be operably coupled with the controller 14, such that the imaging system 70 outputs to the controller 14 information that may directly or indirectly indicate the size and/or composition of the laundry load. Optionally, multiple imaging devices may be spaced about the drum 28 to sense the size and/or composition of the laundry load.

Figure 2:
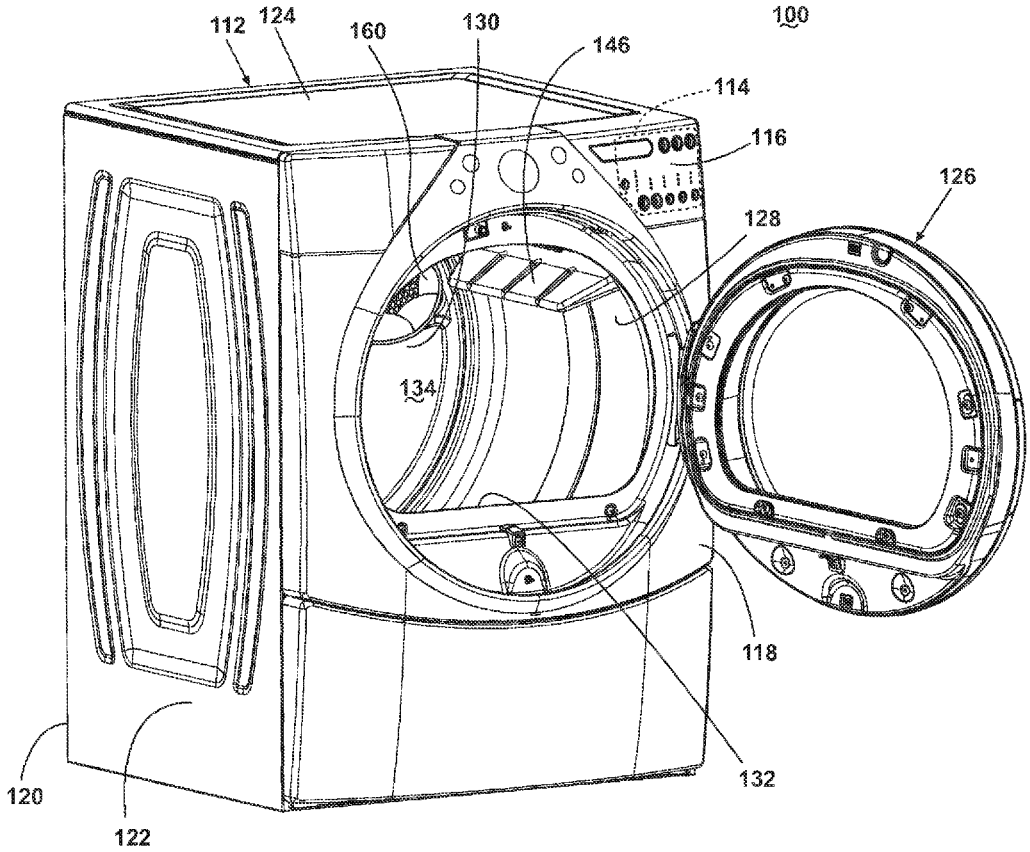
FIG. 2 is a front perspective view of a laundry treating appliance according to a second embodiment of the invention.

FIG. 2 illustrates a second embodiment of the invention in the form of a clothes dryer 100 which is similar in structure to the laundry treating appliance 10. Therefore, elements in the clothes dryer 100 similar to the laundry treating appliance 10 will be numbered with the prefix 100. The clothes dryer 100 described herein shares many features of a traditional automatic clothes dryer which will not be described in detail except as necessary for a complete understanding of the invention.

The clothes dryer 100 may include a cabinet 112 in which may be provided a controller 114 that may receive input from a user through a user interface 116 for selecting a cycle of operation and controlling the operation of the clothes dryer 100 to implement the selected cycle of operation. The cabinet 112 may be defined by a front wall 118, a rear wall 120, and a pair of side walls 122 supporting a top wall 124. A door 126 may be hingedly mounted to the front wall 118 and may be selectively moveable between opened and closed positions to close an opening in the front wall 118, which provides access to the interior of the cabinet 112.

A rotatable drum 128 may be disposed within the interior of the cabinet 112 and may partially define a treating chamber 134 for treating laundry. The drum 128 may be disposed between opposing stationary rear and front walls or bulkheads 130 and 132, which with the drum 128 collectively define the treating chamber 134. The treating chamber 134 may have an open face that may be selectively closed by the door 126. Non-limiting examples of laundry include, but are not limited to, a hat, a scarf, a glove, a sweater, a blouse, a shirt, a pair of shorts, a dress, a sock, a pair of pants, a shoe, an undergarment, and a jacket. Furthermore, textile fabrics in other products, such as draperies, sheets, towels, pillows, and stuffed fabric articles (e.g., toys), may be dried in the clothes dryer 100.

The drum 128 may include at least one lifter 146. In most dryers, there are multiple lifters 146. The lifters 146 may be located along the inner surface of the drum 128 defining an interior circumference of the drum 128. The lifters 146 may facilitate movement of the laundry within the drum 128 as the drum 128 rotates.

Figure 3:
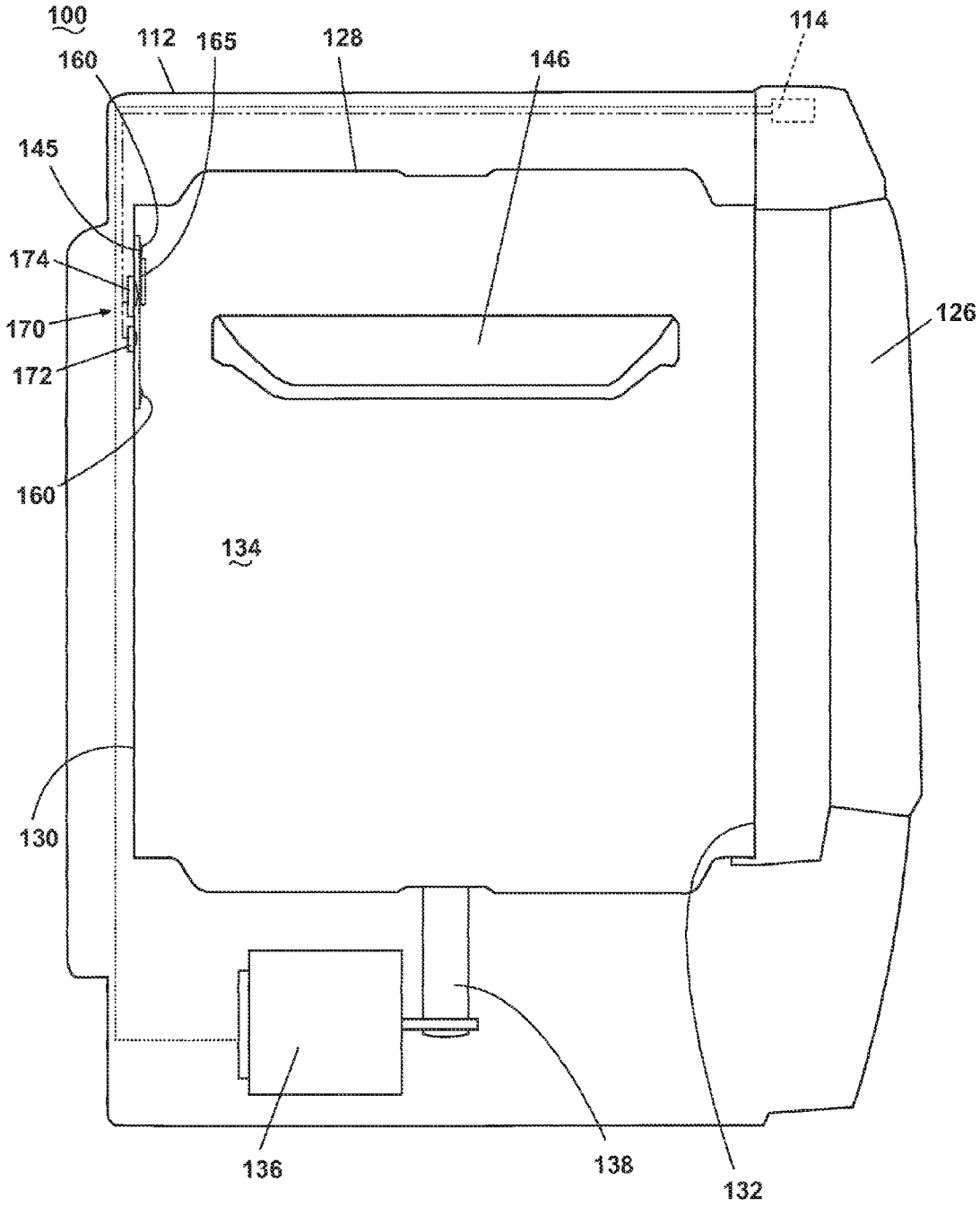
FIG. 3 is a schematic view of the laundry treating appliance of FIG. 2.

Referring now to FIG. 3, which is a schematic view of the clothes dryer 100, as is typical in a clothes dryer, the drum 128 may be rotated by a suitable drive mechanism, such as an indirect drive, which may be illustrated as a motor 136 and a coupled belt 138. Alternately, the motor 136 may be a direct drive motor, as is known in the art. The motor 136 may be operably coupled with the controller 114 to control the rotation of the drum 128 to complete a cycle of operation.

Still referring to FIG. 3, the clothes dryer 100 may also have an imaging system 170 comprising one or more imaging devices 172 and one or more illumination sources 174 to image the treating chamber 134 and/or anything within the treating chamber 134. The imaging system 170 may be similar to that which is described in U.S. patent application Ser. No. 12/388,584, filed Feb. 19, 2009 and titled "Laundry Treating Appliance with Load Surface Area Detection", which is incorporated herein by reference in its entirety. Exemplary imaging devices 172 may include any optical sensor capable of capturing still or moving images, such as a camera. One suitable type of camera may be a CMOS camera. Other exemplary imaging devices include a CCD camera, a digital camera, a video camera or any other type of device capable of capturing an image. The camera may capture visible and/or non-visible radiation. For example, the camera may capture an image using visible light. In another example, the camera may capture an image using non-visible light, such as ultraviolet light. In yet another example, the camera may be a thermal imaging device capable of detecting radiation in the infrared region of the electromagnetic spectrum. The imaging device 172 may be located on either of the rear or front bulkhead 130, 132 or in the door 126. It may be readily understood that the location of the imaging device 172 may be in numerous other locations depending on the particular structure of the clothes dryer 100 and the desired position for obtaining an image. There may also be multiple imaging devices, which may image the same or different areas of the treating chamber 134.

The type of illumination source 174 may vary. In one configuration, the illumination source 174 may be a typical incandescent dryer light which is commonly used to illuminate the treating chamber 134. Alternatively, one or more LED lights may be used in place of an incandescent bulb. The illumination source 174 may be located on the rear bulkhead 130 of the drum 128. The illumination source 174 may alternately be located behind the rear bulkhead 130 such that the light shines through perforations 149 (FIG. 4) which may form an air inlet 145 to the treating chamber 134. It is also within the scope of the invention for the clothes dryer 100 to have more than one illumination source 174. For example, an array of LED lights may be placed at multiple positions in either bulkhead 130, 132.

Figure 4:
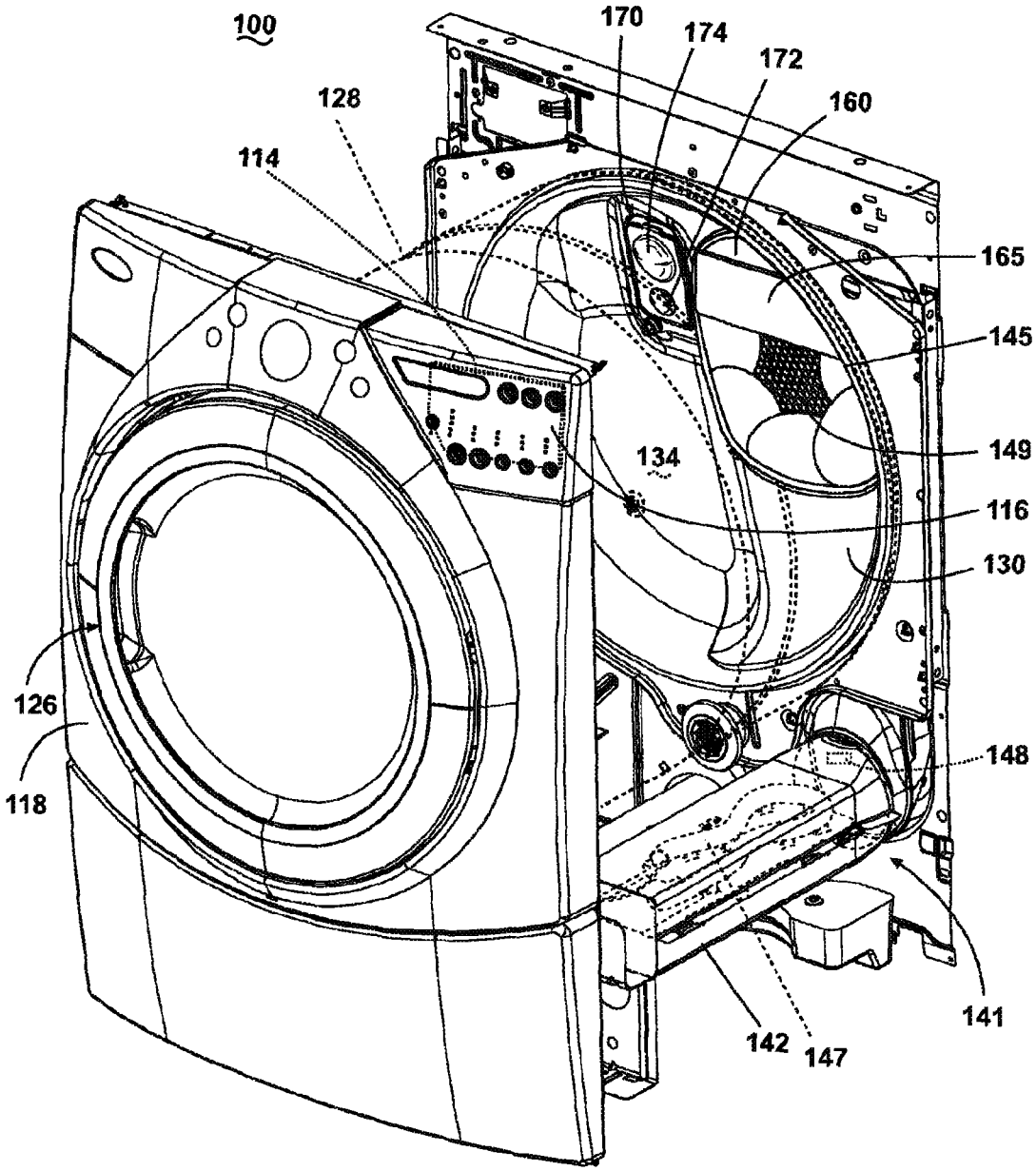
FIG. 4 is a first partial perspective view of the laundry treating appliance of FIG. 2 with portions of the cabinet removed for clarity.
Figure 5:
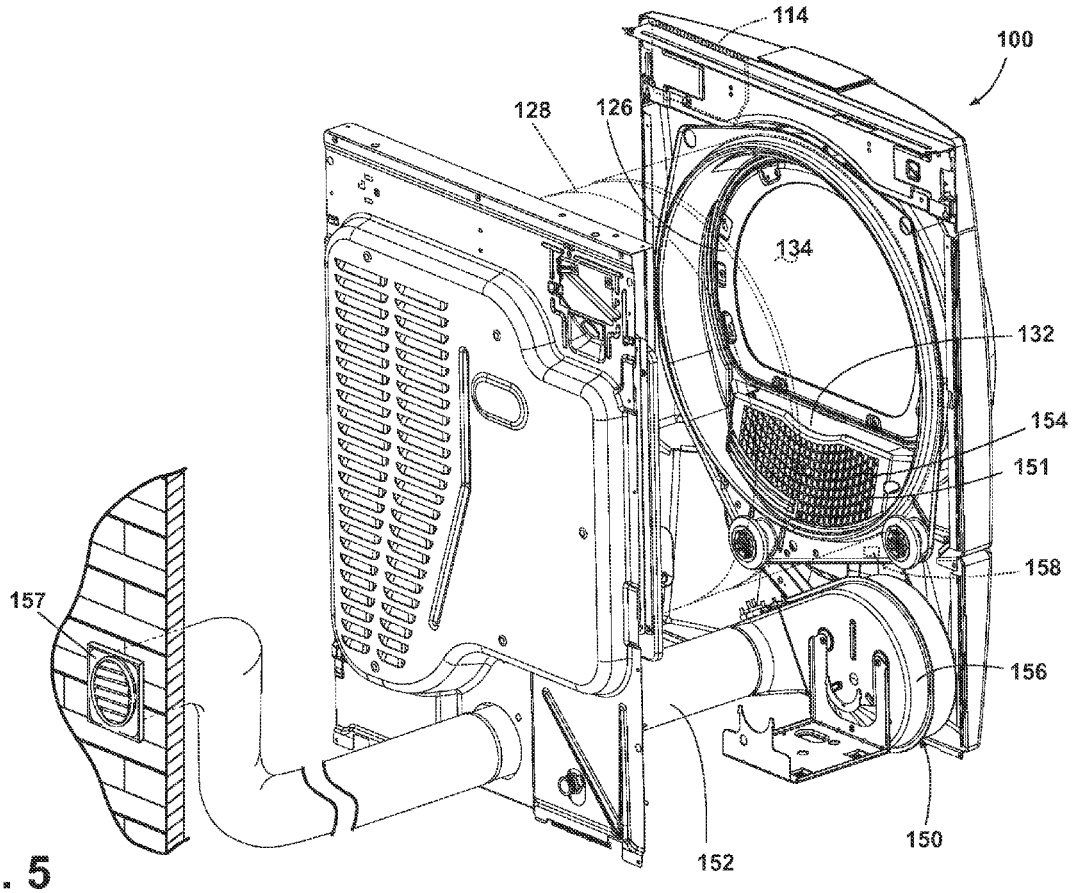
FIG. 5 is a second partial perspective view of the laundry treating appliance of FIG. 2 with portions of the cabinet removed for clarity.

Referring now to FIG. 4, which is a first partial perspective view of the clothes dryer 100 with portions of the cabinet 112 removed for clarity, an air flow system for the clothes dryer 100 according to the second embodiment of the invention will now be described. The air flow system supplies air to the treating chamber 134 through the air inlet 145 and then exhausts air from the treating chamber 134 through an air outlet 151 (FIG. 5). The supplied air may or may not be heated. The air flow system may have an inflow portion 141 that may be formed in part by an inlet conduit 142. The inlet conduit 142 may have one end open to the ambient air and another end fluidly coupled with the air inlet 145 located on the rear bulkhead 130, which is illustrated as an inlet grill in fluid communication with the treating chamber 134 and having a plurality of perforations 149 defining an effective area of air inlet 145. A heating element 147 may lie within the inlet conduit 142 and may be operably coupled with and controlled by the controller 114. If the heating element 147 is turned on, the supplied air will be heated prior to entering the drum 128. The inflow portion 141 may further include an inflow temperature sensor 148 to sense the temperature of the air supplied to the treating chamber 134. The inflow temperature sensor 148 may be located anywhere in the inflow portion 141 to sense the temperature of the air flow before it enters the treating chamber 134 and may be operably coupled with the controller 114. The temperature sensor 148 may be any suitable type of temperature sensor such as a thermistor, thermocouple or RTD, for example.

Referring to FIG. 5, which is a second partial perspective view of the clothes dryer 100 with portions of the cabinet 112 removed for clarity, the air flow system may further include an outflow portion 150 that may be formed in part by the air outlet 151, which may be formed by a lint trap 154 in the front bulkhead 132, and an exhaust conduit 152 which are fluidly coupled by an air mover or blower 156. The blower 156 may be operably coupled with and controlled by the controller 114. Operation of the blower 156 draws air into the treating chamber 134 through the air inlet 145 (FIG. 4) and exhausts air from the treating chamber 134 through the air outlet 151. The exhaust conduit 152 may be fluidly coupled with a household exhaust duct 157 for exhausting the air from the treating chamber 134 to the outside. The outflow portion 151 may further include an outflow temperature sensor 158 to sense the temperature of the air exhausted from the treating chamber 134. The outflow temperature sensor 158 may be located anywhere in the outflow portion 151 to sense the temperature of the air flow after it has been exhausted from the treating chamber 134 through the air outlet 151 and may be operably coupled with the controller 114. The temperature sensor 158 may be any suitable type of temperature sensor such as a thermistor, thermocouple or RTD, for example.

Figure 6:
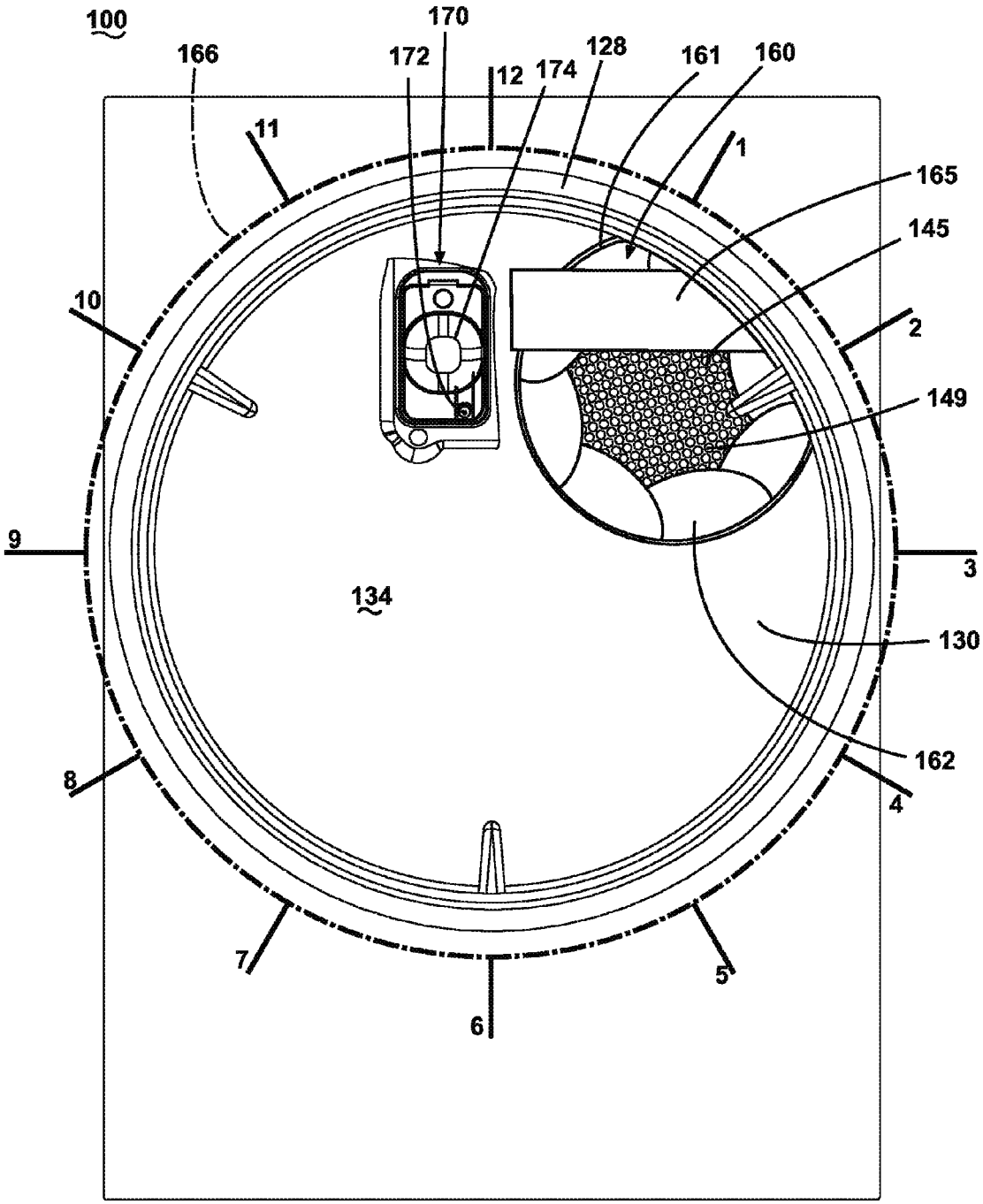
FIG. 6 is a first schematic view of a rear bulkhead of the laundry treating appliance of FIG. 2.

Referring to FIG. 6, which is a first schematic view of the rear bulkhead 130, the clothes dryer 100 may also have an adjustable air flow restrictor 160 fluidly coupled with the air inlet 145 and operable to vary the effective area of the air inlet 145. In this manner, the clothes dryer 100 may be said to include a variable area air inlet 145 fluidly coupled with the treating chamber 134 because the adjustable air flow restrictor 160 may selectively close off or open up a portion of the air inlet 145 to vary the effective area of the air inlet 145. The air flow restrictor 160 may be operably coupled with the controller 114 (FIG. 3) to selectively vary the effective area of the air inlet 145. As illustrated in FIG. 6, the air flow restrictor 160 may include an iris 161 having multiple movable panels 162 that may operate like a shutter and selectively move to vary the effective area of the air inlet 145. More specifically, the multiple moveable panels 162 may selectively operate to block or close at least a fractional area of at least some of the perforations 149 in the air inlet 145 to vary the effective area of the air inlet 145. That is, the air flow restrictor 160 may close off or open up a fractional portion of some of the perforations 149 to vary the effective area of the air inlet 145. Although the air flow restrictor 160 has been illustrated as being located on the inside surface of the rear bulkhead 130, it has been contemplated that the air flow restrictor 160 may be located outside of the rear bulkhead 130. Further, it has been contemplated that the air flow restrictor may take other forms, a non-limiting example being that of a perforated disk located adjacent the plurality of perforations, which may be moved to block or close off fractional portions of at least some of the plurality of perforations.

The clothes dryer 100 may also include an air flow path controller 165 that is fluidly coupled with the air flow path and operable to control the direction of the air flow path between the air inlet 145 and the air outlet 151. The air flow path controller 165 is illustrated as a louver, but may be any device capable of controlling the direction of the air flow path. Thus, although illustrated as a louver, the air flow path controller 165 may include, for example, a baffle, an iris, or an adjustable mask. Further, although illustrated as being located directly over the air inlet 145, the air flow path controller 165 may be arranged in any location within the drum 128. Moreover, although the air flow path controller 165 has been illustrated as being located on the inside of the rear bulkhead 130 it has been contemplated that the air flow path controller 165 may also be located on the outside of the rear bulkhead 130 and still be capable of varying the direction of the air flow path through the treating chamber 134.

In the example of the air flow path controller 165 being a louver, the louver may control the direction of the air flow path by angling the air flow path in different directions within the treating chamber 134. Alternatively, the air flow path controller 165 may control the direction of the air flow path by varying the location of the air inlet 145 relative to the treating chamber 134. This is because the blower 156 pulls the air towards the air outlet 151 located in the lower portion of the front bulkhead 132 (FIG. 5). If the air flow path controller 165 changes the location of the air inlet 145 and the location of the air outlet 151 is stationary, the air flow path in the treating chamber 134 necessarily changes.

Still referring to FIG. 6, the drum 128 may have a circular cross section that bounds a circular area of the rear bulkhead 130. A conceptual clock face 166 may be imposed where the drum 128 meets the rear bulkhead 130. The conceptual clock face 166 has a 12 o'clock (represented with a 12) at the high point of the drum near the rear bulkhead 130 and 6 o'clock (represented with a 6) at the low point of the drum relative the rear bulkhead 130. Additionally, the other numbers of the conceptual clock are shown for reference. The conceptual clock face 166 will be useful in understanding the operation of the second embodiment of the invention.

Referring back to FIGS. 4 and 5, in normal operation of the clothes dryer 100, a user first selects an appropriate cycle of operation by means of the user interface 116. In accordance with the user-selected parameters input at the user interface 116, the controller 114 may control the operation of the rotatable drum 128, the blower 156, the heating element 147, and the air flow restrictor 160, to implement a drying cycle stored in the controller 114 to dry the laundry.

During an exemplary drying cycle, the motor 136 rotates the drum 128 via the belt 138. The blower 156 draws air through the inlet conduit 142 and then circulates past the heating element 147 to heat the air. The heated air may then be propelled through the plurality of perforations 149 forming the effective area of the air inlet 145 and into the treating chamber 134. Air may be vented through the air outlet 151 and exhaust duct 157 to remove moisture from the treating chamber 134. This cycle continues according the selected parameters. The motor 136, blower 156, and heating element 147 may operate independently during the cycle of operation.

The speed of rotation may be constant or varied for the entire drying cycle. A typical rotational speed may be at a rate where the laundry will tumble within the treating chamber 134. That is, the speed may be less than a satellizing speed where the laundry items are held against the interior surface of the drum 128 by centrifugal force throughout a complete rotation. For the illustrated embodiment, the speed of rotation to tumble the laundry items may be about 48 RPM. However, this speed will vary from machine to machine and is dependent on the physical characteristics of the drum 128 as well as other design features and desired results.

Figure 7:
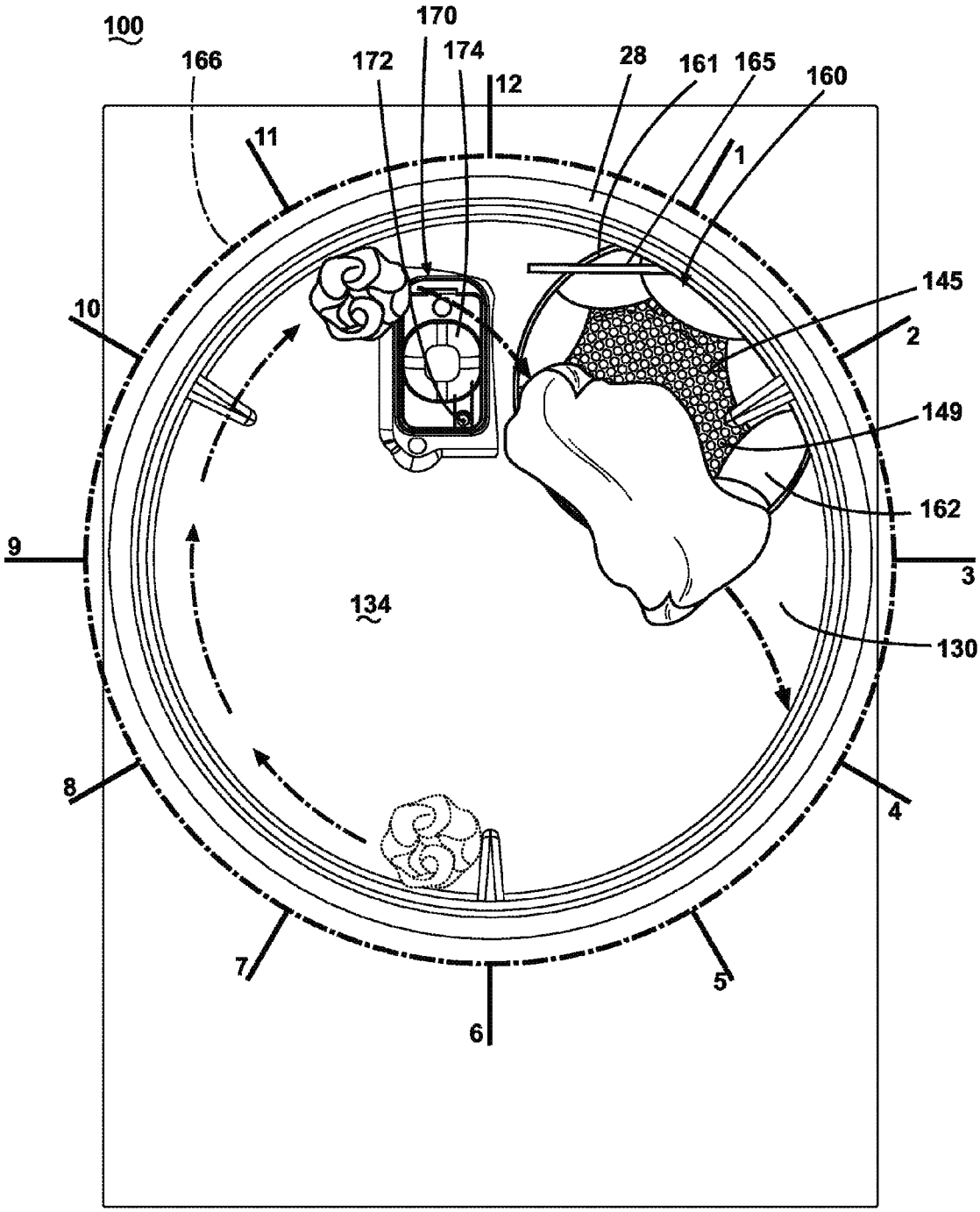
FIG. 7 is a second schematic view of the rear bulkhead of the laundry treating appliance of FIG. 2.

While the drum 128 may be controlled to rotate at a predetermined speed, in reality, the actual drum speed may deviate from the predetermined speed due to a variety of factors, including the size of the drum 128, inertia due to load size, and eccentricities due to load unbalances. However, as shown in FIG. 7, at this speed a laundry article making up a laundry load will rotate with the drum 128 from a location corresponding to approximately the 6 o'clock position in the drum 128, and will detach from the drum 128 and fall downward when the article reaches a location corresponding to approximately the 11 o'clock position in the drum 128. It may be understood that while only one laundry article is shown as making up the laundry load, it may be understood that a laundry load may consist of multiple laundry articles, and that that the multiple laundry articles would generally behave as shown in FIG. 7.

Still referring to FIG. 7, an article may be carried to the 11 o'clock position by the drum 128 from the 6 o'clock position. The article may follow a trajectory attributable to the force of gravity acting on the laundry article to carry the article roughly to the 4 o'clock position. As illustrated, when the article is tumbled in this manner, it may open up inside the drum 128 when it is directly in front of the plurality of perforations 149 forming the effective area of the air inlet 145. The article then passes through the air flow path entering the treating chamber 134, which more effectively dries the laundry. The clothes dryer 100 may operate at a speed where the laundry will tumble in the treating chamber 134 to promote the drying of the laundry. The tumbling aids in opening up the laundry items as they fall, which also improves the rate of drying. The condition where the load rises and falls with rotation of the drum 128 is known as tumbling of the load.

Figure 8:
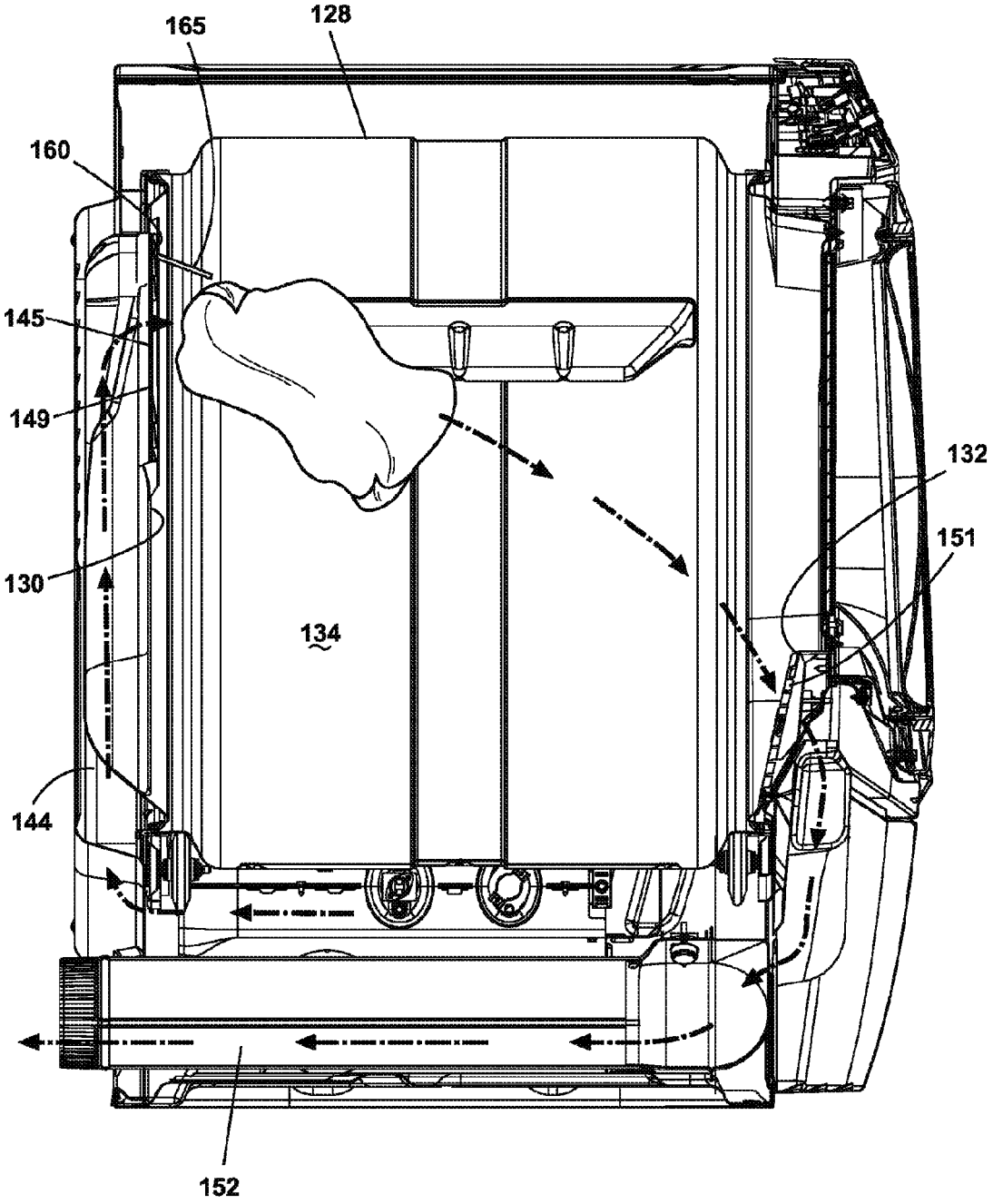
FIG. 8 is a first partial side view of the laundry treating appliance of FIG. 2 with portions of the cabinet removed for clarity and showing a portion of a drying cycle.

FIG. 8 is a first partial side view of the clothes dryer 100 with portions of the cabinet 112 removed for clarity. As illustrated in FIG. 8, when the article detaches at the 11 o'clock position of FIG. 7, it may be released such that it falls in front of the plurality of perforations 149 forming the effective area of the air inlet 145 and in the air flow path through the treating chamber 134. Air enters the treating chamber 134 from the inlet channel 144 through the plurality of perforations 149 forming the effective area of the air inlet 145. This effective area may be varied by the air flow restrictor 160. More specifically, the air flow restrictor 160 may be moved by the controller 114 (FIG. 4) such that it may be positioned to close off or open up at least some of the perforations 149 to vary the effective area of the air inlet 145.

Figure 9:
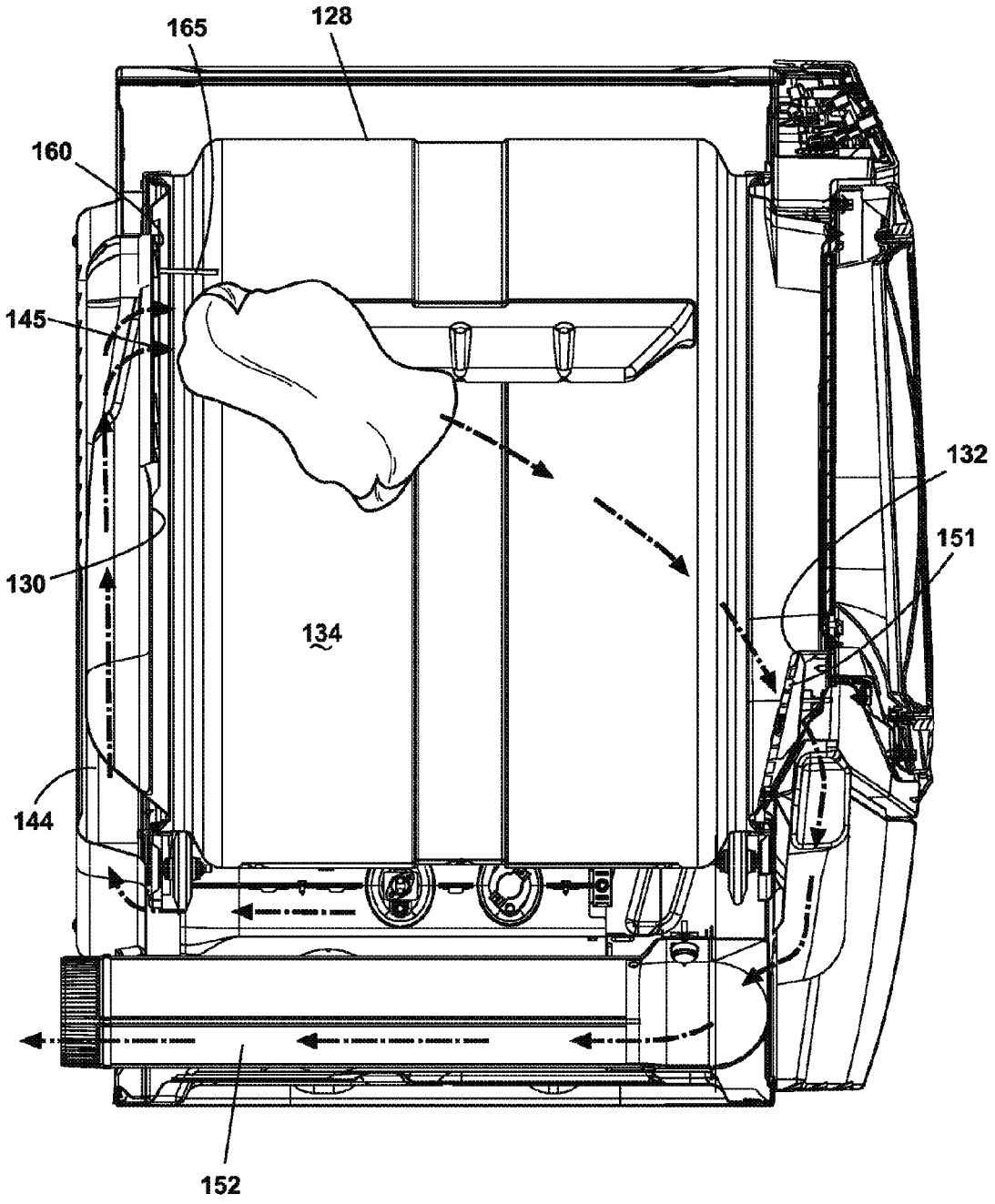
FIG. 9 is a second partial side view of the laundry treating appliance of FIG. 2 with portions of the cabinet removed for clarity and showing a portion of a drying cycle.
Figure 10:
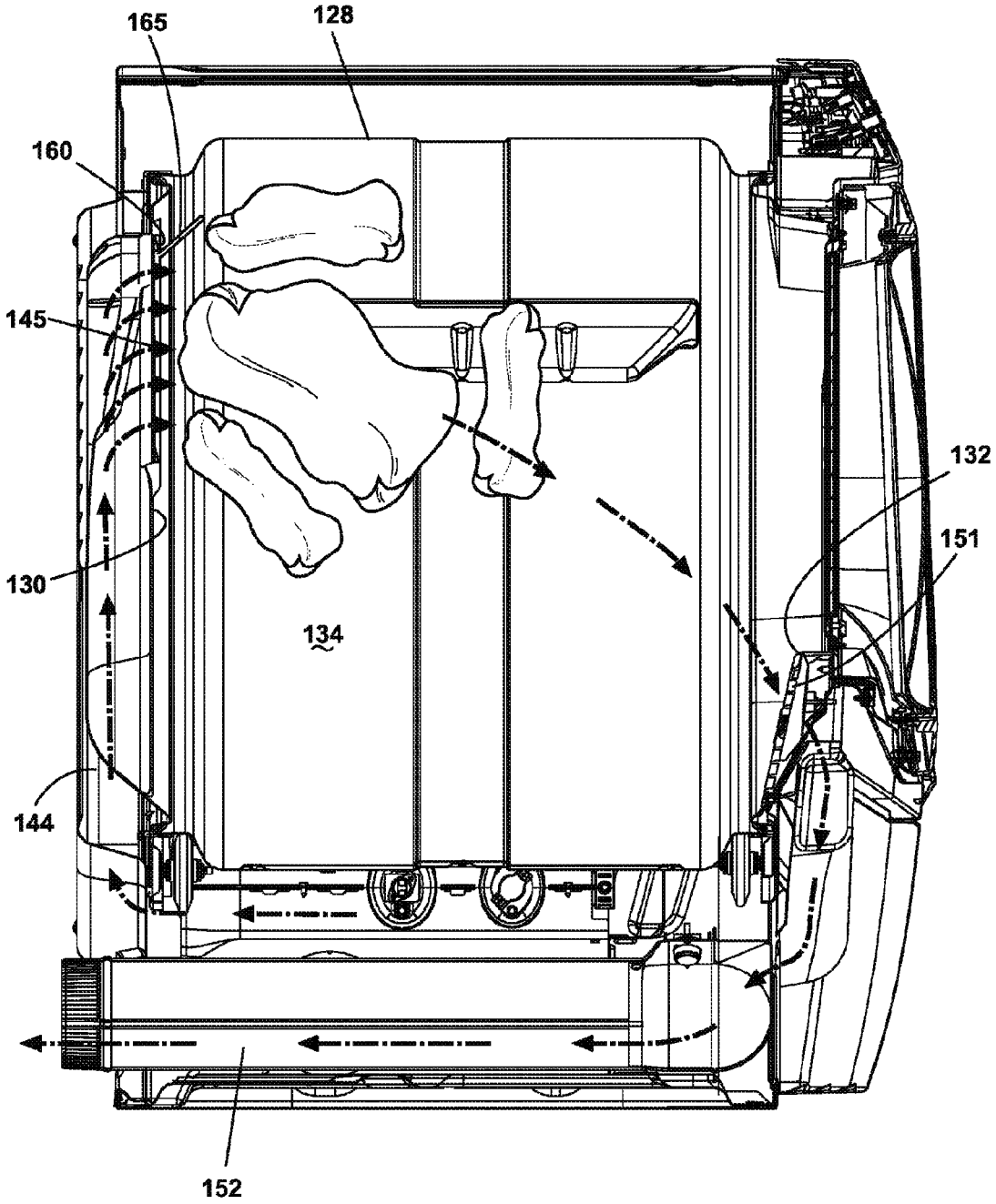
FIG. 10 is a third partial side view of the laundry treating appliance of FIG. 2 with portions of the cabinet removed for clarity and showing a portion of a drying cycle.

FIGS. 9 and 10 are partial side views of the clothes dryer 100 with portions of the cabinet 112 removed for clarity, showing a portion of a drying cycle for a small and larger load, respectively. Varying the effective area of the air inlet 145 allows the air flow path to be concentrated or spread out as needed. As illustrated in FIG. 9, for a small load of laundry, the air flow restrictor 160 may be moved to shrink the effective area of the air inlet 145; this in turn will create a concentrated air flow path. In this manner, the air flow restrictor 160 may avoid wasted air flow, which may pass right by the falling load without any interaction with the articles forming the load. Further, the air flow path controller 165 may be positioned to angle the air flow path in the direction of the article as it falls in front of the plurality of perforations 149 forming the effective area of the air inlet 145. As illustrated in FIG. 10, for larger loads, the air flow restrictor 160 may be moved so that it does not shrink the effective area of the air inlet 145. In this manner, the air flow restrictor 160 may make the effective area of the air inlet 145 as large as possible and may create an air flow path that is more spread out. Maximizing the effective area of the air inlet 145 increases the amount of surface area of the laundry load exposed to the air flow path. Further, the air flow path controller 165 may be angled upwards to allow for a maximized effective area of the air inlet 145.

The air flow restrictor 160 may also affect the direction of the air flow path between the air inlet 145 and the air outlet 151 by changing the location of the air inlet 145. Thus, the air flow restrictor 160 may form the air flow path controller 165. It has also been contemplated that the air flow path controller 165 may form the air flow restrictor 160 as the air flow path controller 165 may act to close off portions of the air inlet 145.

Once the air flow path interacts with the laundry, the air flows through the rest of the treating chamber 134 where it may then be pulled through the air outlet 151 located in the lower portion of the front bulkhead 132 by the blower 156 (FIG. 5). Once the air is removed from the treating chamber 134, it may be exhausted through the exhaust duct 157.

Figure 11:
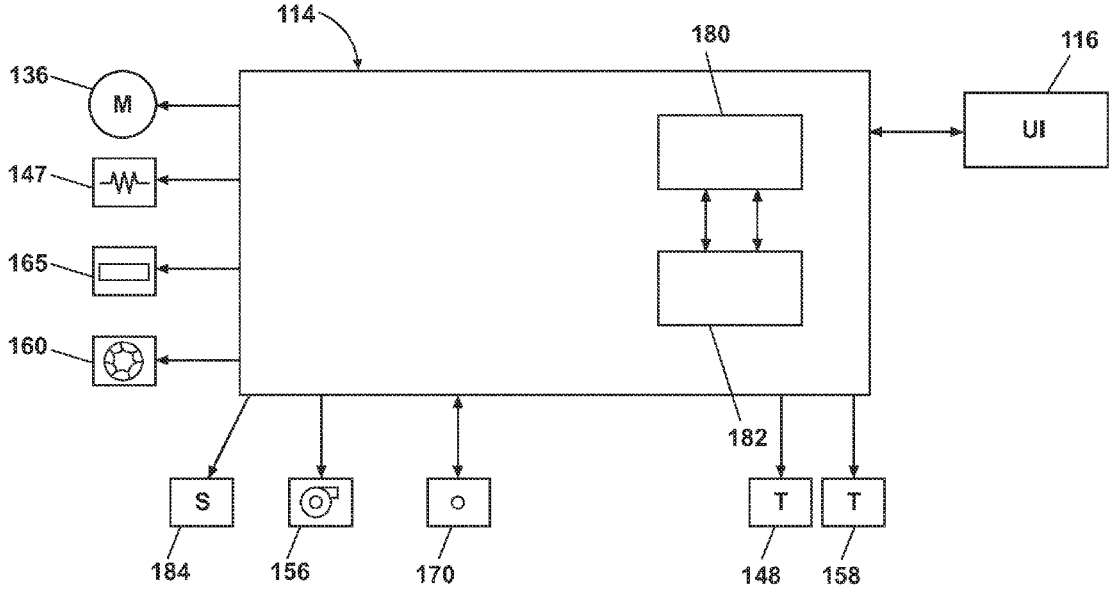
FIG. 11 is schematic representation of a controller for controlling the operation of one or more components of the laundry treating appliance of FIG. 2.

As illustrated in FIG. 11, the controller 114 may be provided with a memory 180 and a central processing unit (CPU) 182. It is contemplated that the controller 114 may be a microprocessor-based controller that implements control software stored in the memory 180 which may be internal to or in communication with the microprocessor. The memory 180 may include one or more software applications, and send/receive one or more electrical signals to/from each of the various working components to affect the control software. Examples of possible controllers are: proportional control (P), proportional integral control (PI), and proportional derivative control (PD), or a combination thereof, a proportional integral derivative control (PID control), which may be used to control the various components of the clothes dryer 100.

The controller 114 may be communicably and/or operably coupled with one or more components of the clothes dryer 100 for communicating with and controlling the operation of the component to complete a cycle of operation. For example, the controller 114 may be coupled with the heating element 147, the inflow temperature sensor 148, the outflow temperature 158, the blower 156 controlling the temperature and flow rate of air through the treating chamber 134; the motor 136 for controlling the direction and speed of rotation of the drum 128; the imaging system 170 for capturing one or more images of the treating chamber 134; the air flow restrictor 160 for changing the area of the inlet airflow; and the air flow path controller 165 for changing the direction of the air flow within the treating chamber 134. The controller 114 may also be coupled with the user interface 116 for receiving user selected inputs and communicating information to the user.

The controller 114 may also receive input from various sensors 184, which are known in the art and not shown for simplicity. Non-limiting examples of sensors 184 that may be communicably coupled with the controller 114 include: a moisture sensor, an air flow rate sensor, a weight sensor, and a motor torque sensor. The sensor 184 may also be a infrared temperature sensor, as is disclosed in U.S. patent application Ser. No. 12/641,519, filed Dec. 18, 2009 and titled "Method for Determining Load Size in a Clothes Dryer Using an Infrared Sensor," which is incorporated herein by reference in its entirety.

Figure 12:
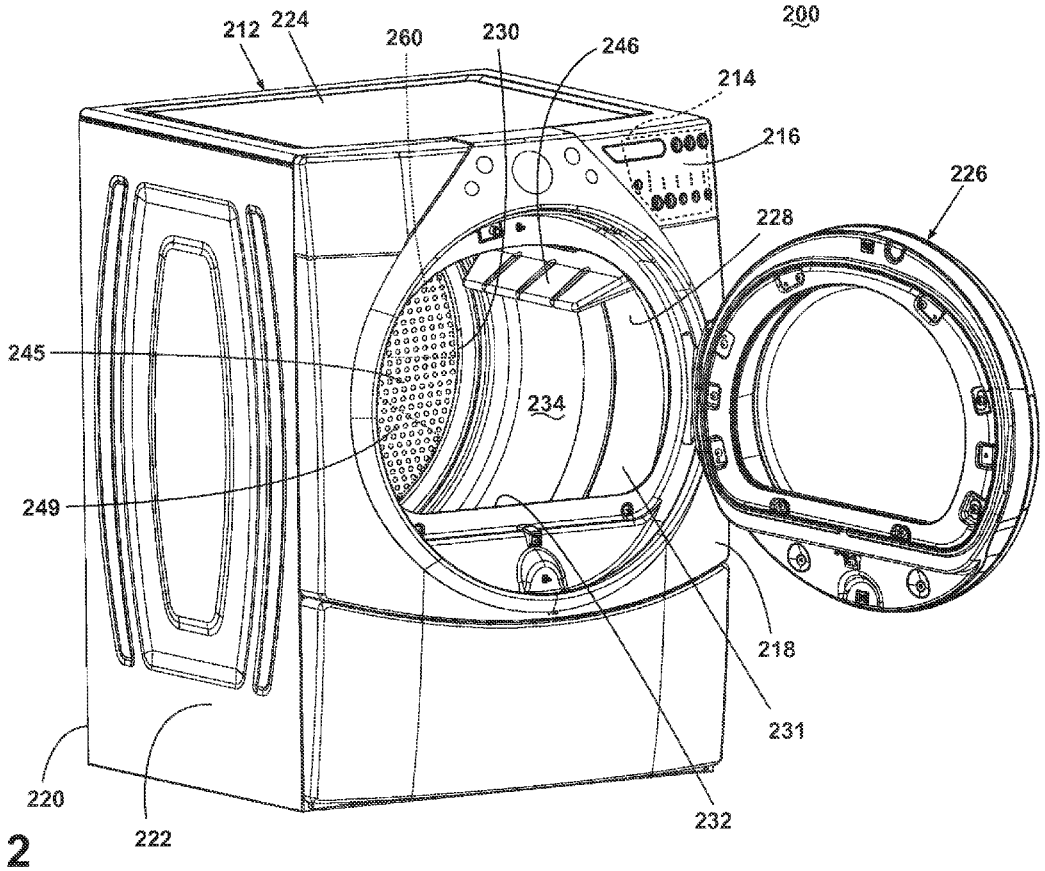
FIG. 12 is a front perspective view of a laundry treating appliance according to a third embodiment of the invention.

FIG. 12 illustrates a clothes dryer 200 according to a third embodiment of the invention. The third embodiment 200 is similar to the second embodiment 100. Therefore, like parts will be identified with like numerals increased by 100, with it being understood that the description of the like parts of the first embodiment applies to the second embodiment, unless otherwise noted.

One difference between the second embodiment and the third embodiment is that the clothes dryer 200 includes an end wall 230 from which extends a peripheral wall 231 to partially define the treating chamber 234 and wherein the end wall 230 has a plurality of perforations 249 defining an air inlet 245. A rotatable drum 228, like the drum 128 described above in the second embodiment, may form the peripheral wall 231.

Figure 13:
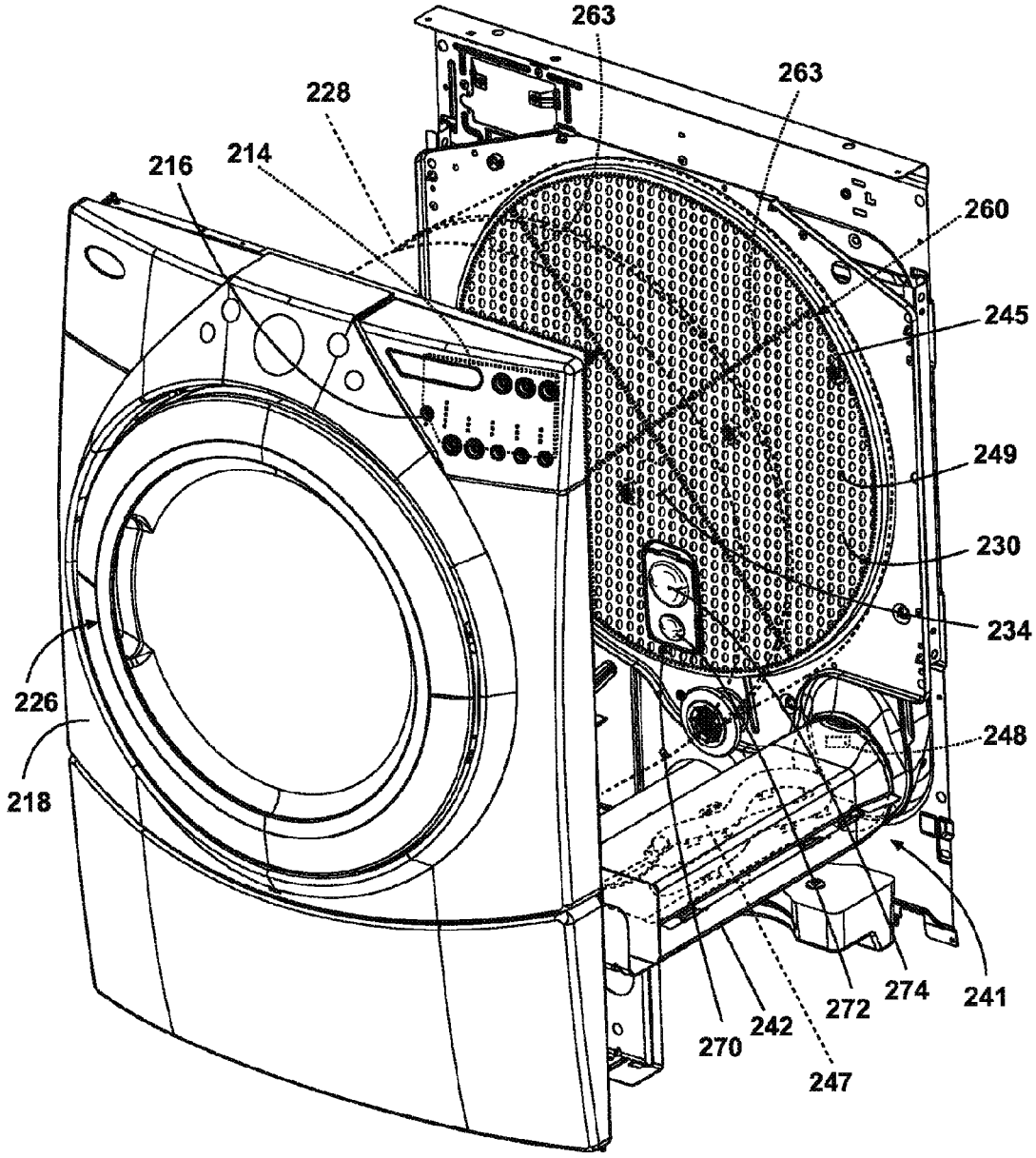
FIG. 13 is a partial perspective view of the laundry treating appliance of FIG. 12 with portions of the cabinet removed for clarity.

FIG. 13 is a partial perspective view of the clothes dryer 200, with portions of the cabinet 212 removed for clarity. FIG. 13 more clearly illustrates that the majority of the end wall 230 may include the perforations 249. A second difference between the second embodiment and the third embodiment is that the flow restrictor 260 may include a pair of rotatable disk segments 263 located exteriorly of the treating chamber 234 adjacent the end wall 230. The pair of rotatable disk segments 263 may be configured to selectively close at least some of the perforations 249 defining the air inlet 245 to vary the effective area of the air inlet 245 and make it a variable-area air inlet 245. Although the pair of rotatable disk segments 263 has been illustrated and described as being located on the exterior of the treating chamber 234 adjacent the end wall 230, it has been contemplated that the pair of rotatable disk segments 263 may be located inside the treating chamber 234 adjacent the end wall 230. In either case, the pair of rotatable disk segments 263 may be coupled with a simple drive system (not shown) that may move the pair of rotatable disk segments 263 to vary both the effective area of the air inlet 245 and the location of the air inlet 245. This configuration may provide for the independent control of each of the rotatable disk segments 263.

Figure 14:
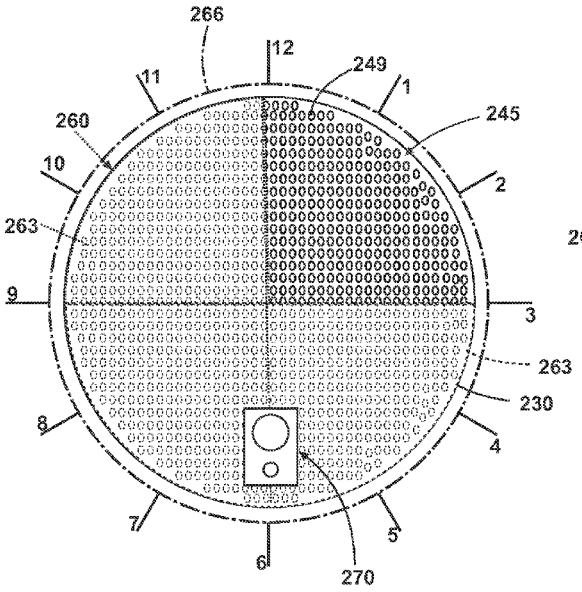
FIG. 14 is a first schematic view of an end wall and pair of rotatable disk segments of the laundry treating appliance of FIG. 12.
Figure 15:
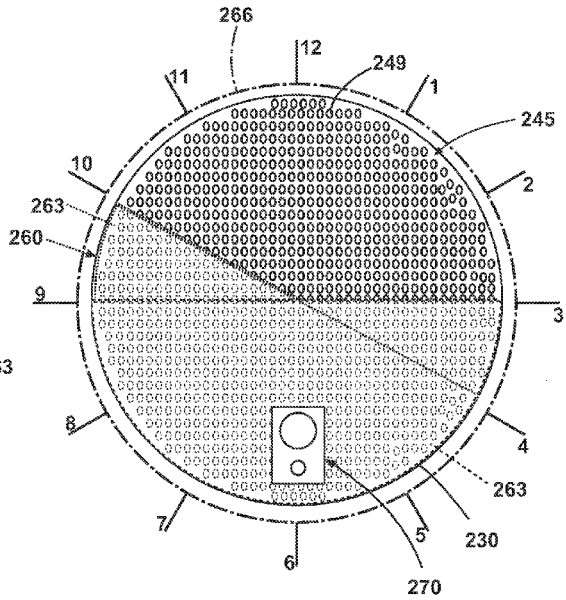
FIG. 15 is a second schematic view of the end wall and pair of rotatable disk segments of the laundry treating appliance of FIG. 12.

FIGS. 14 and 15 are schematic views of the end wall 230 and the rotatable disk segments 263. As one example, FIG. 14 shows the rotatable disk segments 263 positioned to form an air inlet 245 that encompasses approximately a quarter of the end wall 230 and may be located roughly between the 12 o'clock and 3 o'clock positions. FIG. 15 shows another example where the rotatable disk segments 263 are positioned to form an air inlet 245 that encompasses almost half of the end wall 230 and may be located roughly between the 10 o'clock and 3 o'clock positions. Thus, as the flow restrictor 260 selectively closes different perforations 249 the location of the air inlet 245 on the end wall 230 may be altered. With almost the entire end wall 230 being perforated and each disk 263 being approximately half of the entire area of the end wall 230, even if the pair of rotatable disk segments 263 are entirely overlapped, the maximum inlet area 245 that may be achieved may be only one half of the perforated area of the end wall 230. Thus, the perforated portion of the end wall 230 clearly has a greater area than the operationally maximum inlet area 245, and this allows the air inlet 245 to be located at multiple positions on the end wall 230.

As the rotatable disk segments 263 alter the location of the air inlet 245 they may also form an air flow path controller that controls the direction of the air flow path between the air inlet 245 and the air outlet 251. Alternatively, the clothes dryer 200 may also include an air flow path controller fluidly coupled with the air flow path to control the direction of the air flow path between the air inlet 245 and the air outlet 251. Although not illustrated, the air flow path controller may include a louver, a baffle, an iris, an adjustable mask, or any combination thereof.

The previously described laundry treating appliances 10, 100, and 200 may be used to implement one or more embodiments of a method of the invention. An embodiment of the method will now be described in terms of the operation of the clothes dryer 100 shown in FIGS. 2-11. The method functions to supply air into the treating chamber 134 through the air inlet 145 and control the supplied air by varying the effective area of the air inlet 145.

Figure 16:
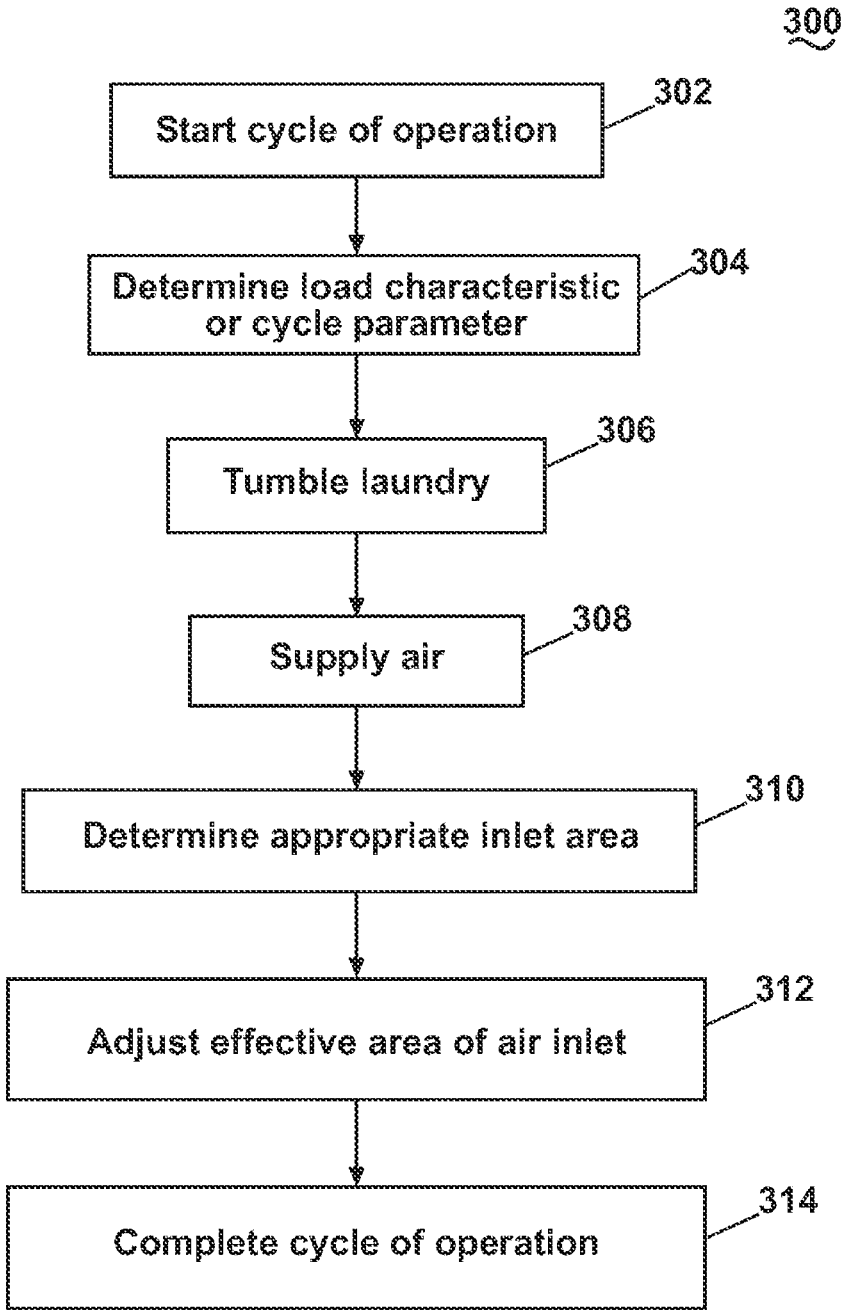
FIG. 16 is a flow chart illustrating a method for supplying air into a treating chamber of a laundry treating appliance through an air inlet and controlling the supplied air by varying the effective area of the air inlet according to an embodiment of the invention.

Referring to FIG. 16, a flow chart of a method 300 of supplying air into the treating chamber 134 through the air inlet 145 and controlling the supplied air by varying the effective area of the air inlet 145 is shown in accordance with the present invention. The method 300 may be executed by the controller 114 during a drying cycle of the clothes dryer 100. The sequence of steps depicted is for illustrative purposes only, and is not meant to limit the method 300 in any way as it is understood that the steps may proceed in a different logical order or additional or intervening steps may be included without detracting from the invention. While the method 300 is described in the context of the clothes dryer 100, it is understood that method 300 may also be used with the laundry treating appliance 10 and the laundry treating appliance 200.

The method 300 starts under the assumption that the user has loaded the clothes dryer 100 with one or more articles to form the laundry load and closed the door 126. The user may also initially set at least one parameter of a cycle of operation including a rotational speed of the drum 128, a direction of rotation of the drum 128, a temperature in the treating chamber 134, an air flow through the treating chamber 134, an amount of laundry in the treating chamber 134, a start or end of cycle condition, and a start or end cycle step condition.

Setting a start or end of cycle condition may include determining when to start or end a cycle of operation. This may include signaling the controller 114 to immediately start or end a cycle of operation or setting a time at which to start or end a cycle of operation. Setting a start or end of cycle step condition may include determining when to start a step or phase within a given operating cycle or when to end a step within a given operating cycle. This may include signaling the controller 114 to immediately transition from one cycle step to another or setting a time at which to transition from one step to another within a given operating cycle. Examples of cycle steps include rotation with heated air, rotation without heated air, treatment dispensing, a wrinkle guard step and cool down step.

The method 300 may be initiated at the start of a user-selected operating cycle or at some predetermined time after the start of the user selected operating cycle at 302. At 304, a cycle parameter or characteristic of the laundry load may be determined. As illustrated, the determination at 304 may be part of the drying cycle or it may alternatively be a separate cycle completed prior to the start of the drying cycle. A non-limiting example of a cycle parameter, which may be determined in step 304, is the determination of whether a treatment dispensing step is part of the operating cycle.

One example of a characteristic of the laundry load, which may be determined in step 304, is the tumble path of the laundry load. The path of the laundry load may be determined by any suitable method. For example, the path of the laundry may be determined based upon the speed of rotation of the drum, such as described in U.S. Patent Application No.

61/077,511, filed Jul. 2, 2008 and titled "A Method For Removing Chemistry Buildup in a Dispensing Dryer," which is incorporated herein by reference in its entirety. The specific manner in which the tumble path of the load is determined is not germane to the invention and therefore it is within the scope of the invention for any suitable method to be used to determine the tumble path of the load.

Another example of a characteristic of the laundry load that may be determined is the moisture content of the laundry load. The moisture content of the laundry may be estimated using any suitable method. For example, the moisture content of the laundry may be based on the readings of one or more moisture sensors in the form of conductivity strips, such as is described in U.S. Pat. No. 6,446,357 to Woerdehoff et al. The specific manner in which the moisture content of the load is determined is not germane to the invention and therefore it is within the scope of the invention for any suitable method to be used to determine the moisture content of the load.

Alternatively, in step 304 the amount of the laundry load may be determined. Determining the amount of the laundry load may include determining the mass, weight, volume, packing density and area of the laundry load and may be done in any suitable manner. For example, the load amount determination may be provided by a user via user interface 116 or via data indicative of the load amount received from one or more sensors related to the motor 136, the drum 128 or any other components of the clothes dryer 100. In another example, the drum 128 may be rotated to acquire one or more motor characteristics which may be used to derive the amount of the load. The characteristic of the motor 136 may be any data related to the operation of the motor 136, such as motor torque, motor speed, motor current and motor voltage.

The load amount may also be determined based on the readings from one or more temperature sensors. One method for determining the load amount is set forth in U.S. patent application Ser. No. 12/641,519, referenced above. An infrared temperature sensor, such as sensor 184, may be used to obtain multiple temperature readings inside the treating chamber 134 of the clothes dryer 100. The variation in the temperature readings may be used to determine the load amount.

In another example, the amount of the load may be determined based on the surface area of the load. The surface area of the load may be determined using any suitable method. One method for determining the surface area of the load is set forth in U.S. patent application Ser. No. 12/388,584, referenced above. According to the load surface area method of U.S. patent application Ser. No. 12/388,584, the imaging device 170 may be used to capture one or more images of a treating chamber. The captured images may be sent to the controller 114 for analysis using software associated with the controller to determine the surface area of the load within the treating chamber 134.

In another example, the amount of the load may be determined based on the packing density of the load. The packing density of the load may be determined using any suitable method. One method for determining the packing density of the load is set forth in U.S. patent application Ser. No. 12/538,473, filed Aug. 10, 2009 and titled "Laundry Treating Appliance with Tumble Pattern Control," which is incorporated herein by reference in its entirety. The method according to U.S. patent application Ser. No. 12/538,473 converts the motor torque signal while the drum 128 is rotating from the time domain to the frequency domain in order to estimate the packing density. The packing density may be characterized in terms of the free space within the treating chamber 134 not occupied by the load, the ratio of the volume of the laundry load to the total volume of the treating chamber 134 or the ratio of the free volume of the treating chamber 134 to the total volume of the treating chamber 134.

Once the characteristic of the laundry load or cycle parameter has been determined at 304, the drum 128 may be rotated at 306 to tumble the laundry and air may be supplied into the treating chamber 134 through the air inlet 145 at 308. At 310 the characteristic of the laundry load or cycle parameter determined at 304 may be used by software stored in the memory 180 of the controller 114 to determine what the effective area of the air inlet 145 should be based on the determine characteristic of the laundry load or cycle parameter. Accordingly, the air flow restrictor 160 may be controlled to adjust the effective area of the air inlet at 312. For example, the effective area of the air inlet 145 may be increased if the determined moisture content of the load is high. As another example, the effective area of the air inlet 145 may be increased for a larger load amount and decreased for a smaller load amount. As yet another example, if the determined cycle parameter indicates that a treating chemistry is to be sprayed into the treating chamber 34 during a treatment dispensing step the effective area of the air inlet 145 may be increased to help disperse the spray evenly in the treating chamber 34.

More specifically, the determined characteristic of the laundry load or cycle parameter may be used by the controller 114 to set the effective area of the air inlet 145 by moving the multiple movable panels 162 of the air flow restrictor 160 to achieve the desired effective area of the air inlet 145. The effective area of the air inlet 145 may be varied by the multiple moveable panels 162 blocking portions of the air inlet 145. This may reduce the area of the air inlet and may vary the direction of the air flow path through the treating chamber 134.

The direction of the air flow path through the treating chamber 134 may be varied because the location of the air inlet 145 may be moved depending on the portions of the air inlet 145 that are blocked by the multiple moveable panels 162. Thus, the method may include controlling the supplied air by varying the direction of the air flow path through the treating chamber 134. If the tumble path of the laundry load has been determined, the controller 114 may set the direction of the air flow path such that it may intersect with the determined tumble path. Once the effective area of the air inlet has been adjusted at 312, the controller 114 may operate at 314 to control the operation of the clothes dryer 100 to complete the cycle of operation.

Typical dryers do not provide satisfactory control of airflow based on load sizes and fabric types. The effective drying of laundry articles remains a persistent problem area as the application of excess heated airflow may be energy inefficient and the application of insufficient heated airflow may result in an operating cycle that is longer than necessary. The method 300 may be used to increase energy and time efficiency by maximizing the interaction of the air flow path with the laundry load and thus maximizing the removal of water during the drying process while minimizing the energy provided to the system. Avoiding wasted air flow saves both time and energy.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry treating appliance for treating laundry in accordance with an automatic cycle of operation, comprising:

a cabinet;

a treating chamber located within the cabinet and configured to receive laundry for treatment;

a variable-area air inlet fluidly coupled with the treating chamber, the variable-area air inlet including a plurality of perforations, and a flow restrictor to selectively block at least two of the perforations to vary an area of the variable-area air inlet;

an air outlet fluidly coupled with the treating chamber, with the air inlet and air outlet defining an air flow path through the treating chamber; and an air mover fluidly coupled with at least one of the air inlet and air outlet to effect the movement of air along the air flow path.

2. The laundry treating appliance of claim 1, further comprising an end wall from which extends a peripheral wall to partially define the treating chamber, wherein the end wall has the plurality of perforations.

3. The laundry treating appliance of claim 2, further comprising a rotatable drum forming the peripheral wall.

4. The laundry treating appliance of claim 1 wherein the flow restrictor comprises a pair of rotatable disk segments adjacent an end wall.

5. The laundry treating appliance of claim 4 wherein the plurality of perforations on the end wall is of a greater area than the operationally maximum inlet area.

6. The laundry treating appliance of claim 1, further comprising an air flow path controller fluidly coupled with the air flow path to control the direction of the air flow path between the air inlet and the air outlet.

7. The laundry treating appliance of claim 1 wherein the flow restrictor comprises at least one of a louver, a baffle, an iris, or an adjustable mask.

8. The laundry treating appliance of claim 6 wherein the air flow restrictor forms the air flow path controller.

* * * * *